US007581729B2

(12) United States Patent
Fujita et al.

(10) Patent No.: US 7,581,729 B2
(45) Date of Patent: Sep. 1, 2009

(54) SHEET CONVEYING APPARATUS AND IMAGE FORMING APPARATUS

(75) Inventors: Takashi Fujita, Kashiwa (JP); Noriaki Koyanagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/468,474

(22) Filed: Aug. 30, 2006

(65) Prior Publication Data

US 2007/0052162 A1 Mar. 8, 2007

(30) Foreign Application Priority Data

Sep. 7, 2005 (JP) ..... 2005-259933

(51) Int. Cl.
*B65H 9/16* (2006.01)

(52) U.S. Cl. ..... 271/248; 271/251

(58) Field of Classification Search ..... 271/240, 271/248, 249, 250, 251, 253
See application file for complete search history.

(56) References Cited

U.S. PATENT DOCUMENTS

| | | | | |
|---|---|---|---|---|
| 4,019,732 | A * | 4/1977 | Hunt et al. | 271/245 |
| 5,091,754 | A * | 2/1992 | Abe et al. | 399/394 |
| 5,092,579 | A * | 3/1992 | Tokoro et al. | 271/240 |
| 5,156,391 | A | 10/1992 | Roller | 271/227 |
| 5,209,467 | A * | 5/1993 | Schmaling | 271/240 |
| 5,411,252 | A * | 5/1995 | Lowell | 271/240 |
| 5,937,260 | A * | 8/1999 | Taninaka et al. | 399/401 |
| 6,273,418 | B1 | 8/2001 | Fujikura et al. | 271/228 |
| 6,945,528 | B2 * | 9/2005 | Nakamura | 271/171 |
| 7,080,831 | B2 * | 7/2006 | Sasamoto et al. | 271/3.03 |
| 7,306,221 | B2 * | 12/2007 | Agata | 271/251 |
| 7,374,165 | B2 * | 5/2008 | Agata | 271/248 |
| 7,404,557 | B2 * | 7/2008 | Tada et al. | 271/226 |
| 2004/0188929 | A1 * | 9/2004 | Tada et al. | 271/248 |
| 2005/0012263 | A1 | 1/2005 | Koyanagi et al. | 271/227 |
| 2006/0091599 | A1 * | 5/2006 | Okuda et al. | 271/248 |
| 2006/0170149 | A1 * | 8/2006 | Seto | 271/240 |

FOREIGN PATENT DOCUMENTS

| | | |
|---|---|---|
| JP | 5-201587 | 8/1993 |
| JP | 11-189355 | 7/1999 |

* cited by examiner

*Primary Examiner*—Kaitlin S Joerger
(74) *Attorney, Agent, or Firm*—Fitzpatrick, Cella, Harper & Scinto

(57) ABSTRACT

A sheet conveying path is constituted by a fixed guide portion and a movable guide portion movable in a width direction orthogonal to the conveyance direction of a sheet for regulating the position of one side edge of the sheet by a skew feed correcting portion, and an auxiliary guide for guiding the sheet is provided between the fixed guide portion and the movable guide portion for movement in the width direction. When the skew feed of the conveyed sheet is corrected, the movable guide portion is moved in advance to a position corresponding to the size of the sheet, and in operative association with the movable guide portion, the auxiliary guide is moved to a guide position corresponding to the size of the sheet.

11 Claims, 19 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and particularly to a skew feed correcting portion for correcting the skew feed of a sheet.

2. Description of the Related Art

In an image forming apparatus such as a printer, a copying machine or a printing machine, a toner image or an ink image is formed on a conveyed sheet by an electrophotographic printing method, an offset printing method, an ink jet printing method or the like.

A color image forming apparatus using, for example, the electrophotographic printing method is classified, from its construction, chiefly into a tandem type in which a plurality of image forming portions are juxtaposed, and a rotary type in which a plurality of image forming portions are disposed in a cylindrical shape. Also, from its transferring method, it is classified into a direct transfer type in which a toner image is directly transferred from a photosensitive drum which is an image bearing member to a sheet, and an intermediate transfer type in which a toner image is once transferred to an intermediate transfer member, and thereafter is transferred to a sheet.

Here, in an intermediate transfer tandem type wherein image forming portions of four colors are juxtaposed on an intermediate transfer belt, it is not necessary to hold a sheet on a transfer drum or a transfer belt as in the direct transfer type. Therefore, a color image forming apparatus adopting the intermediate transfer tandem type can cope with a variety of materials such as super-thick paper and coat paper and moreover, is suitable for the realization of high productivity because of its features such as the parallel processing in the plurality of image forming portions and the collective transfer of a full-color image.

Now, in recent years, in the field of such an electrophotographic printing apparatus, there have been provided apparatuses which make the most of the merit of making no print, and aims, for example, at a print-on-demand (POD) market for effecting a small number of prints. However, in order to be accepted by such a quick printing market, it is necessary to achieve a high quality of image, and as an important factor for achieving the high quality of image, there is an image position to a sheet. This image position accuracy includes the deviation of the front side and back side when two-side images have been formed.

When the image position accuracy to the sheet is to be improved, it is necessary to improve the accuracy of the registration in the conveyance direction of the sheet, the registration in a direction of the sheet, an image magnification, skew feed correction, etc.

Here, the registration in the conveyance direction, the registration in the direction orthogonal to the conveyance direction and the magnification can be corrected by electrical control, but the skew feed in difficult to correct by the electrical control.

For example, it is possible to detect the skew feed of a sheet, and form an image inclined in accordance therewith to thereby correct the image position to the sheet. However, particularly in the case of a color image in which three or four colors are superposed one upon another, when an image is inclined on each sheet, the hue is changed for each sheet by the deviation of the dot formation of each color. Also, much time is required for the calculation for inclining the image, thus resulting a remarkable reduction in productivity. Consequently, the correction of the skew feed is determined by the performance of the conveyance accuracy of the sheet.

So, heretofore, a skew feed correcting portion for correcting the skew feed of a sheet has been provided in a sheet conveying apparatus for conveying the sheet to a transferring portions, so as to correct the skew feed of the sheet. Here, a method of correcting the skew feed of the sheet is divided broadly into the following four methods.

1. A pair of registration rollers are disposed upstream of the transferring portions, and the leading edge of the conveyed sheet is rammed against the registration rollers being at a halt to thereby push in the sheet from the trailing edge side thereof, and form a loop, thereby effecting skew feed correction. Thereafter, the registration rollers are re-started in synchronism with the image, to thereby effect the skew feed correction and the image adjustment in the conveyance direction of the sheet.

2. By the use of a retractable shutter instead of the registration rollers, the leading edge of the conveyed sheet is rammed against it is thereby form a loop, thus effecting skew feed correction. Thereafter, on the basis of the detection of the leading edge of the sheet by a sensor, the position adjustment with the sheet is effected, and skew feed correction and the image adjustment in the conveyance direction of the sheet are effected.

3. The sheet is rammed against a conveyance reference wall provided in the conveyance direction of the sheet by a obliquely feed roller and is conveyed at the same time to thereby correct the skew feed of the sheet, and the image position adjustment in the conveyance direction is effected by detecting the leading edge of the sheet by a sensor and controlling the conveyance speed of the sheet (disclosed, for example, in Japanese Patent Application Laid-open No. H11-189355).

4. Provision is made of means for detecting the skew feed of the sheet and two drive rollers capable of driving independently in a direction perpendicular to the conveyance direction of the sheet, and the speeds of the respective drive rollers are changed in accordance with the skew feed amount of the sheet to thereby correct the skew feed (disclosed, for example, in Japanese Patent Application Laid-open No. H05-201587).

Here, the third method, when viewed regarding the deviation of the front side and back side of the images during two-side printing, has the merit that although the sheet is switched back, whereby the leading edge and the trailing edge change places with each other between a first side and a second side, the sides do not change places with each other and therefore, skew feed can be corrected on the same reference for both of the first side and the second side. In the other methods, skew feed correction is effected at the leading edge and therefore, the reference for effecting correction differs between the first side and the second side and thus, when the parallelism between the leading and trailing edges of the sheet is not sufficient, the deviation between the front side and the back side will occur even if the correction capability is high.

FIG. 16 of the accompanying drawings is a plan view showing the construction of a skew feed correcting portion which corrects skew feed by such a third method. This skew feed correcting portion is provided in a sheet conveying apparatus for conveying a sheet on the so-called center reference.

In FIG. 16, a obliquely feed roller guide portion 100 is provided with a side regulating plate 105 and obliquely feed rollers 253, 254 and 255. These obliquely feed rollers 253, 254 and 255 are inclined and provided on a lower guide 102 side so as to convey the sheet toward the side regulating plate 105. When the sheet S is conveyed by the obliquely feed rollers 253, 254 and 255, the sheet S is rammed against a reference wall 105*a* provided on the side regulating plate 105 shown in FIG. 18 of the accompanying drawings which will be described later, and has its skew feed corrected thereby.

The reference numeral 115 designates a fixed lower guide constituting a sheet conveying path together with the obliquely feed roller guide portion 100, which is movable relative to the fixed lower guide 115 in a width direction orthogonal to the conveyance direction of the sheet.

Here, the obliquely feed roller guide portion 100 is movable in accordance with the size of the sheet S, and is moved in advance to a position corresponding to the size before the sheet S is conveyed thereto, thereby contriving the higher efficiency of the correction time. When the skew feed of a sheet Smax of a maximum size is to be corrected, as shown in FIG. 16, the gap between the obliquely feed roller guide portion 100 and the fixed lower guide 115 becomes a maximum Gmax. Also, when the skew feed of a sheet 5 min of a minimum size is to be corrected, as shown in FIG. 17 of the accompanying drawings, the gap between the obliquely feed roller guide portion 100 and the fixed lower guide 115 becomes a minimum Gmin. The wider is the range of the passable sheet size, the greater becomes the gap between the obliquely feed roller guide portion 100 and the fixed lower guide 115 when the sheet of the maximum size is passed.

Now, the sheet conveying apparatus provided with such a conventional skew feed correcting portion suffers from the following problems. The greater is the difference between the maximum size and minimum size of conveyable sheets, the wider becomes the gap between the obliquely feed roller guide portion 100 and the fixed lower guide 115 when the skew feed of the sheet of the maximum size is corrected. When the gap between the guides thus becomes wide, downward flexure indicated by arrow P at the central portion as shown in FIG. 18 is caused to occur to the sheet S by its gravity.

When the sheet S is conveyed with the downward flexure thus caused to occur to the sheet, as shown a side view of in the apparatus of FIG. 19 of the accompanying drawings, the central portion of the sheet S is sometimes caught by the entrance lower guide 300*b* of a pair of registration rollers 131 and 132 provided downstream of a lower guide 102 and the fixed lower guide 115. When the sheet S is thus caught, jam is caused or bending occurs to the central portion of the sheet. This tendency is more remarkable in the case of thin sheets of weak stiffness.

SUMMARY OF THE INVENTION

So, the present invention has been made in view of such present situation, and has as its object to provide a sheet conveying apparatus and an image forming apparatus which can correct skew feed without causing jam or bending and can convey a sheet.

The present invention provides a sheet conveying apparatus provided with a skew feed correcting portion for correcting the skew feed of a conveyed sheet, the skew feed correcting portion comprising: a first guide portion movable in a width direction orthogonal to a conveyance direction of the sheet to regulate a position of one side edge of the conveyed sheet; a second guide portion provided opposite to the first guide portion to guide the other side edge of the sheet; and an auxiliary guide provided between the first guide portion and the second guide portion, and movable in the width direction of the sheet, wherein the first guide portion is moved in advance to a position corresponding to a size of the conveyed sheet, and the auxiliary guide is moved to a guide position corresponding to the size of the sheet in operative association with the first guide portion.

Further features of the present invention will become apparent from the following description of exemplary embodiments with reference to the attached drawings.

DESCRIPTION OF THE EMBODIMENTS

An aspect of carrying out the present invention will hereinafter be described in detail with reference to the accompanying drawings.

Figure 1:
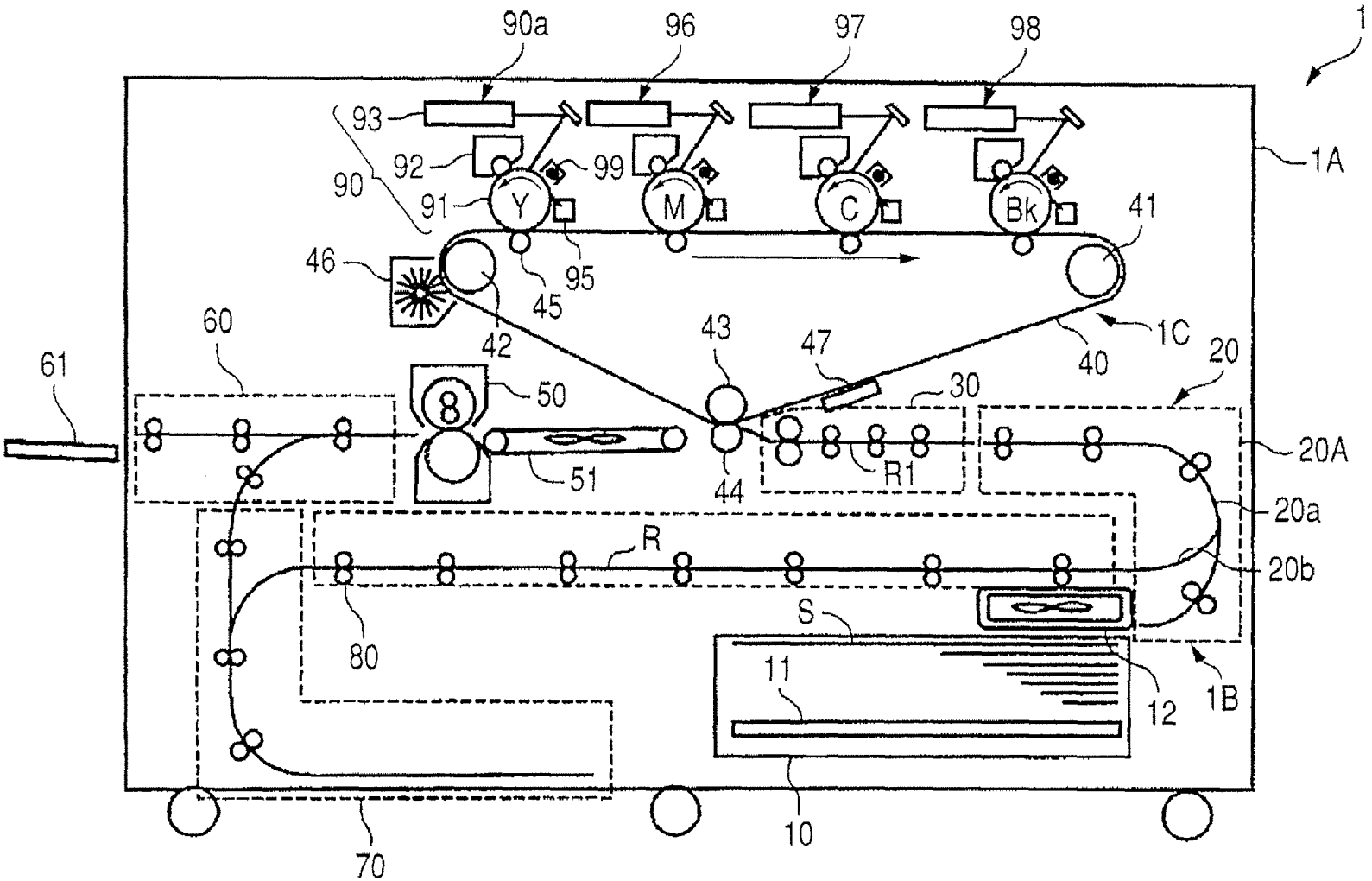
FIG. 1 schematically shows the construction of a color image forming apparatus which is an example of an image forming apparatus according to a first embodiment of the present invention.

FIG. 1 schematically shows the instruction of a color image forming apparatus which is an example of an image forming apparatus according to a first embodiment of the present invention.

In FIG. 1, the color image forming apparatus main body (hereinafter referred to as the apparatus main body) 1A of the color image forming apparatus 1 is provided with a sheet feeding portion 1B for feeding a sheet S, an image writing-in portion 90 for forming a toner image, and a transferring portion 1C for transferring the toner image formed by the image writing-in portion 90 to the sheet S fed by the sheet feeding portion 1B. The image forming portion of the color image forming apparatus 1 is constituted by the image writing-in portion 90 and the transferring portion 1C.

In FIG. 1, a sheet conveying apparatus 20 conveys the sheet S fed by the sheet feeding portion 1B to the transferring portion 1C. This sheet conveying apparatus 20 is provided with a registration unit 30 which is a skew feed correcting portion for effecting the skew feed correction and timing correction of the sheet S, and a conveying roller portion 20A for conveying the sheet to the registration unit 30.

Here, the image writing-in portion 90 is constituted by four image forming units 90*a*, 96, 97 and 98 of yellow (Y), magenta (M), cyan (C) and black (Bk). Each of these image forming units 90*a*, 96, 97 and 98 is comprised of a photosensitive member 91, an exposing device 93, a developing device 92, a primary transfer device 45 and a photosensitive member cleaner 95.

The color image forming apparatus 1 according to the present embodiment is of an intermediate transfer tandem type in which the image forming units 90*a*, 96, 97 and 98 of the four colors as image forming portions are juxtaposed on an intermediate transfer belt, which will be described later. The colors formed by the image forming units 90*a*, 96, 97 and 98 are not restricted to these four colors, nor the arrangement order of the colors is restricted to the named order.

Also, the sheet feeding portion 1B is provided with a sheet supplying cassette 10 which is a sheet contained in a form stacked on a lift-up device 11 and from which the sheets can be drawn out, and sheet feeding means 12 for feeding out the sheets S contained in the sheet supplying cassette 10. Here, as this sheet feeding means 12, mention may be made of a type utilizing the frictional separation by a sheet feeding roller or the like, or a type utilizing the separation suction by air, but in the present embodiment, the sheet feeding method by air is mentioned as an example.

Also, the transferring portion 10C is provided with an intermediate transfer belt 40 passed over such rollers as a drive roller 42, a tension roller 41 and a secondary transfer inner roller 43, and driven to convey in the direction indicated by the arrow in FIG. 1.

Here, this intermediate transfer belt 40 has transferred thereto a toner image formed on the photosensitive member, by a predetermined pressure force and an electrostatic load bias given by a primary transfer device 45. Also, in a secondary transferring portion formed by the secondary transfer inner roller 43 and a secondary transfer outer roller 44 substantially opposed to each other, the predetermined pressure force and the electrostatic load bias are given to thereby cause an unfixed image to be attracted to the sheet S.

A patch detecting sensor 47 is provided upstream of the secondary transfer inner roller 43, and detects the color misregister of multi-transferred toner images and the leading edge position of the toner images. Also, a cleaner 46 is provided downstream of the secondary transfer inner roller 43, and collects any toners residual on the intermediate transfer belt 40.

When an image is to be formed in the color image forming apparatus 1 of such a construction, the surface of the photosensitive member 91 is first uniformly charged in advance by charging means (not shown). Thereafter, the exposing device 93 emits light to the photosensitive member 91 rotated in the direction indicated by the arrow, on the basis of the signal of image information sent thereto, and applies this light suitably via reflecting means or the like, whereby a latent image is formed on the surface of the photosensitive member. Any untransferred toner residual on the photosensitive member 91 is collected by the photosensitive member cleaner 95.

Next, toner development is effected on the electrostatic latent image formed on the photosensitive member 91 in this manner by the developing device 92, and a toner image is formed on the photosensitive member. Thereafter, a predetermined pressure force and an electrostatic load bias are given to the intermediate transfer belt 40 by the primary transfer device 45, and the toner image is transferred onto the intermediate transfer belt 40.

The image formation by the Y, M, C and Bk image forming units 90*a*, 96, 97 and 98 of the image writing-in portion 90 is effected at the timing whereat the images are superposed on the upstream toner image primary-transferred onto the intermediate transfer belt. As the result, finally, a full-color toner image is formed on the intermediate transfer belt 40.

Also, the sheet S is fed out of the sheet supplying cassette 10 by the sheet feeding means 12 in timed relationship with the image formation of the image writing-in portion 90, whereafter the sheet S passes through a conveying path 20*a* and is conveyed to the registration unit 30. In this registration unit 30, the skewfeed correction and timing correction of the sheet are effected, whereafter the sheet S is conveyed to a secondary transferring portion formed by the secondary transfer inner roller 43 and the secondary transfer outer roller 44 opposed to each other. Thereafter, in the secondary transferring portion, a predetermined pressure force and an electrostatic load bias are given to the sheet S, whereby a full-color toner image is secondary-transferred onto the sheet S.

The sheet S onto which the toner image has been thus secondary-transferred is conveyed to a fixing device 50 by an ante-fixing conveying portion 51. Then, in this fixing device 50, a predetermined pressure force by rollers substantially opposed to each other or a belt, and generally a heating effect by a heat source such as a heater are applied to the sheet S to thereby fuse and fix the toner on the sheet S.

Next, the sheet S having thereon a fixed image obtained in this manner is intactly discharged onto a sheet discharge tray 61 by a branching-off conveying device 60. When images are to be formed on the two sides of the sheet S, the sheet S is conveyed to a reversal conveying device 70 by the changeover of a flapper (not shown).

Here, when the sheet S is thus conveyed to the reversal conveying device 70, the sheet S has its leading and trailing edges changed in places by a switchback operation and is conveyed to a re-conveying path R provided in a duplex conveying device 80. Thereafter, the sheet S joins from the sheet re-feeding path 20*b* of the sheet conveying apparatus 20 is timed relationship with the sheet of the succeeding job conveyed from the sheet feeding portion 1B, and is likewise conveyed to the secondary transferring portion. The image forming process is similar to that for the first side and therefore need not be described.

Figure 4:
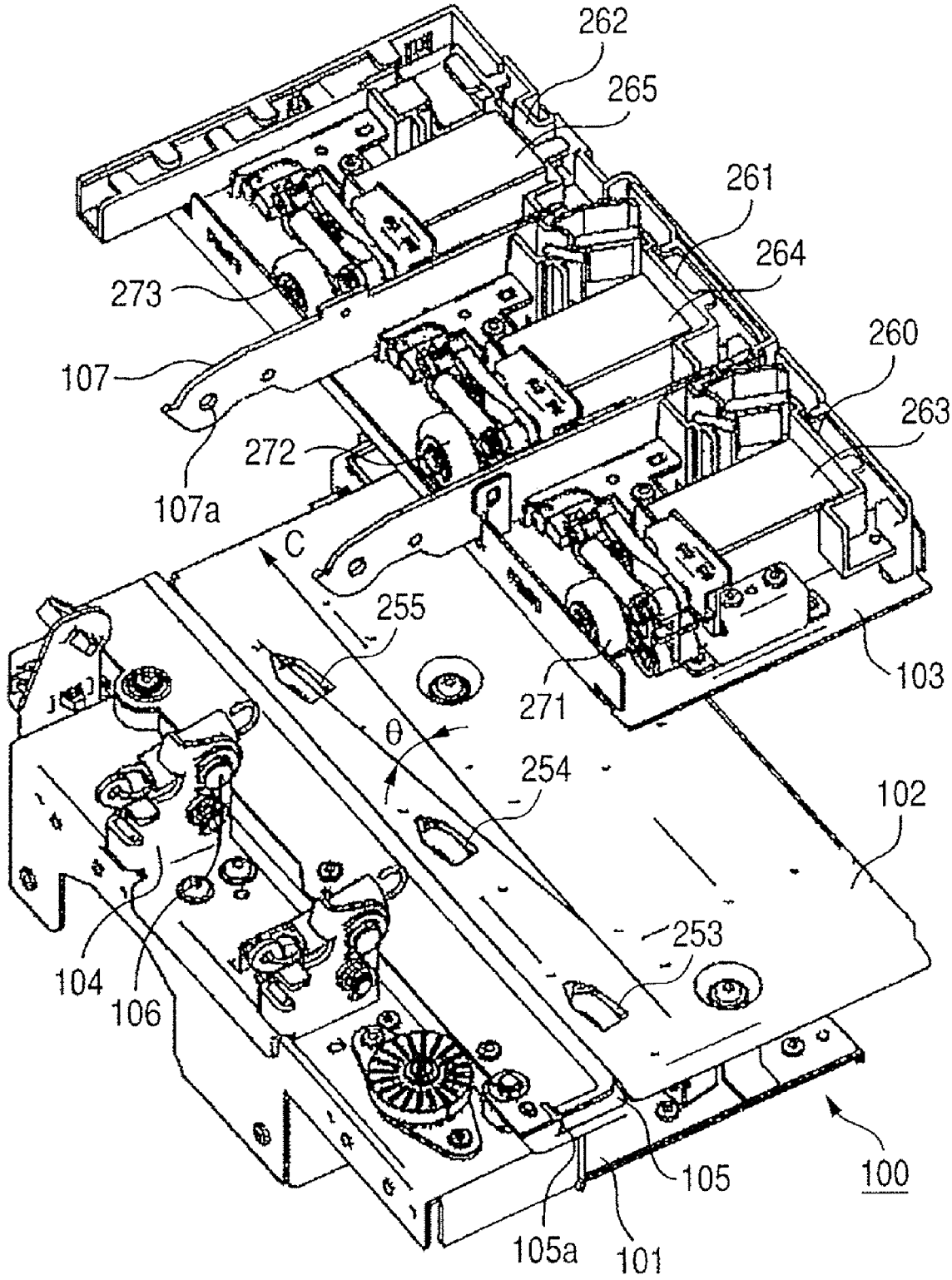
FIG. 4 is a perspective view of a obliquely feed roller guide portion provided in the registration unit.

Now, the registration unit 30 is provided with a sheet conveying path R1 and skew feed correcting means provided with a reference guide 105*a* provided on one side edge of the sheet conveying path R1 and extending in the conveyance direction of the sheet as shown in FIG. 4, and obliquely feed rollers 253, 254 and 255 for pushing a side edge of the sheet S against the reference guide 105*a*. The skew feed of the sheet S is corrected by this skew feed correcting means so as to correct the position of the sheet S in the width direction thereof (main scanning direction).

Here, the positioning of the sheet is effected by the end portion of the sheet being rammed against the reference guide 105*a* by the obliquely feed rollers 253, 254 and 255. The position of this reference guide 105*a* in a direction orthogonal to the conveyance direction of the sheet is offset by a predetermined amount outwardly from the position of a regular sheet conveyance reference (the reference of the side edge portion of the sheet when the sheet is set as being regularly conveyed with the center reference). This is because if the reference guide 105*a* is positioned at the sheet conveyance reference, the sheet and the reference guide 105*a* may interfere with each other due to the irregularity of the sheet actually conveyed with the center reference.

Therefore, in the registration unit 30, one side edge of the sheet is regulated by the reference guide 105*a* at a position offset by a predetermined amount outwardly from the sheet conveyance reference, whereafter this offset amount is returned. Thereby, the sheet being conveyed can be positioned at the sheet conveyance reference. Accordingly, in the registration unit 30, the skew feed of the sheet being conveyed can be corrected and also, the sheet being conveyed can be made coincident with a sheet conveyance reference position in the direction orthogonal to the conveyance direction, and an image forming process of high accuracy can be carried out.

Figure 2:
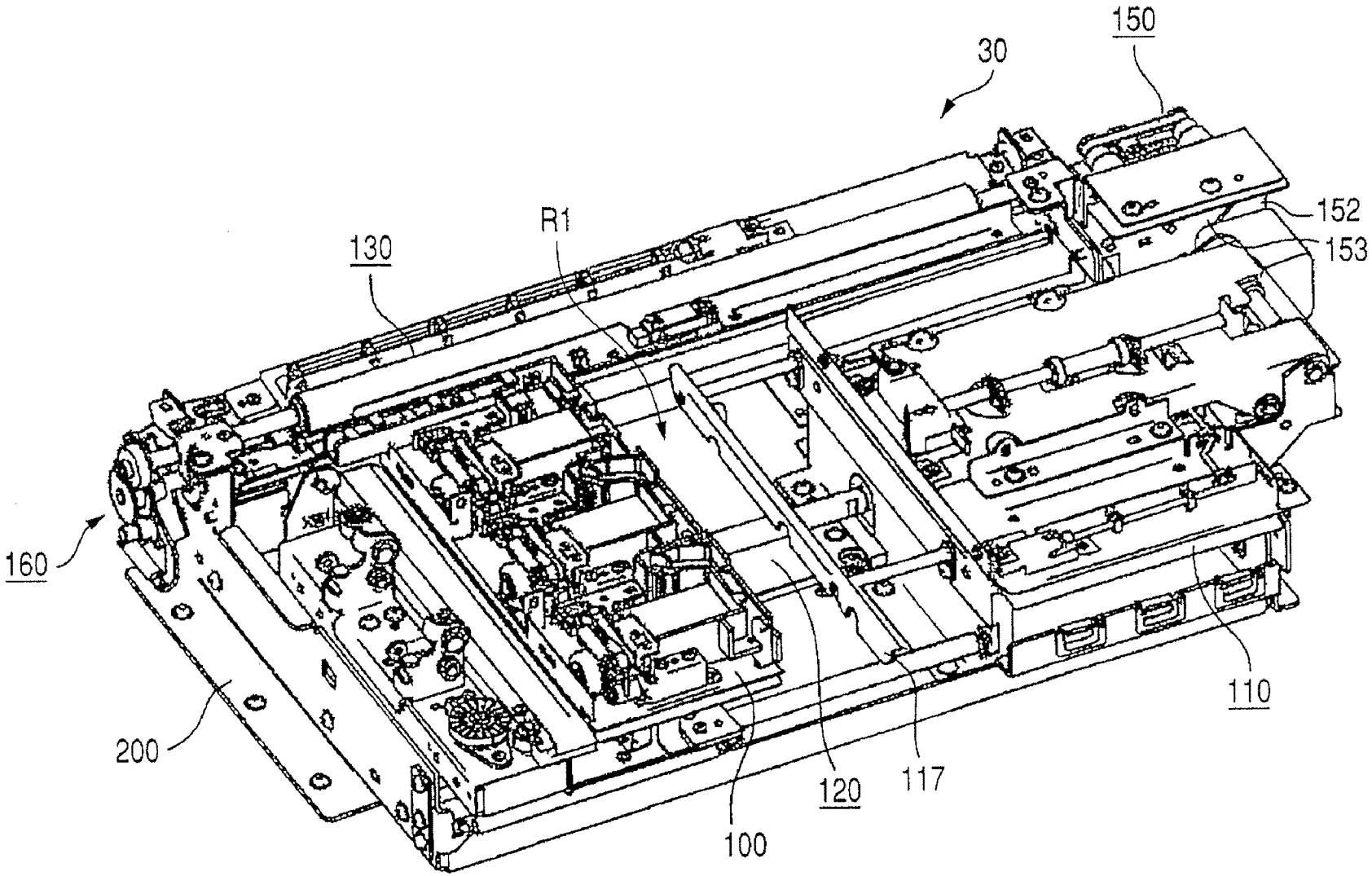
FIG. 2 is a perspective view of a registration unit provided in the color image forming apparatus.

FIG. 2 is a perspective view of such a registration unit 30. This registration unit 30 is constituted by an obliquely feed roller guide portion 100, a fixed guide portion 110, an obliquely feed guide moving driving portion 120, a registration roller portion 130, a registration roller slide portion 150, a registration roller pressure releasing portion 160, etc. The reference numeral 200 designates the frame of the registration unit 30.

Figure 3:
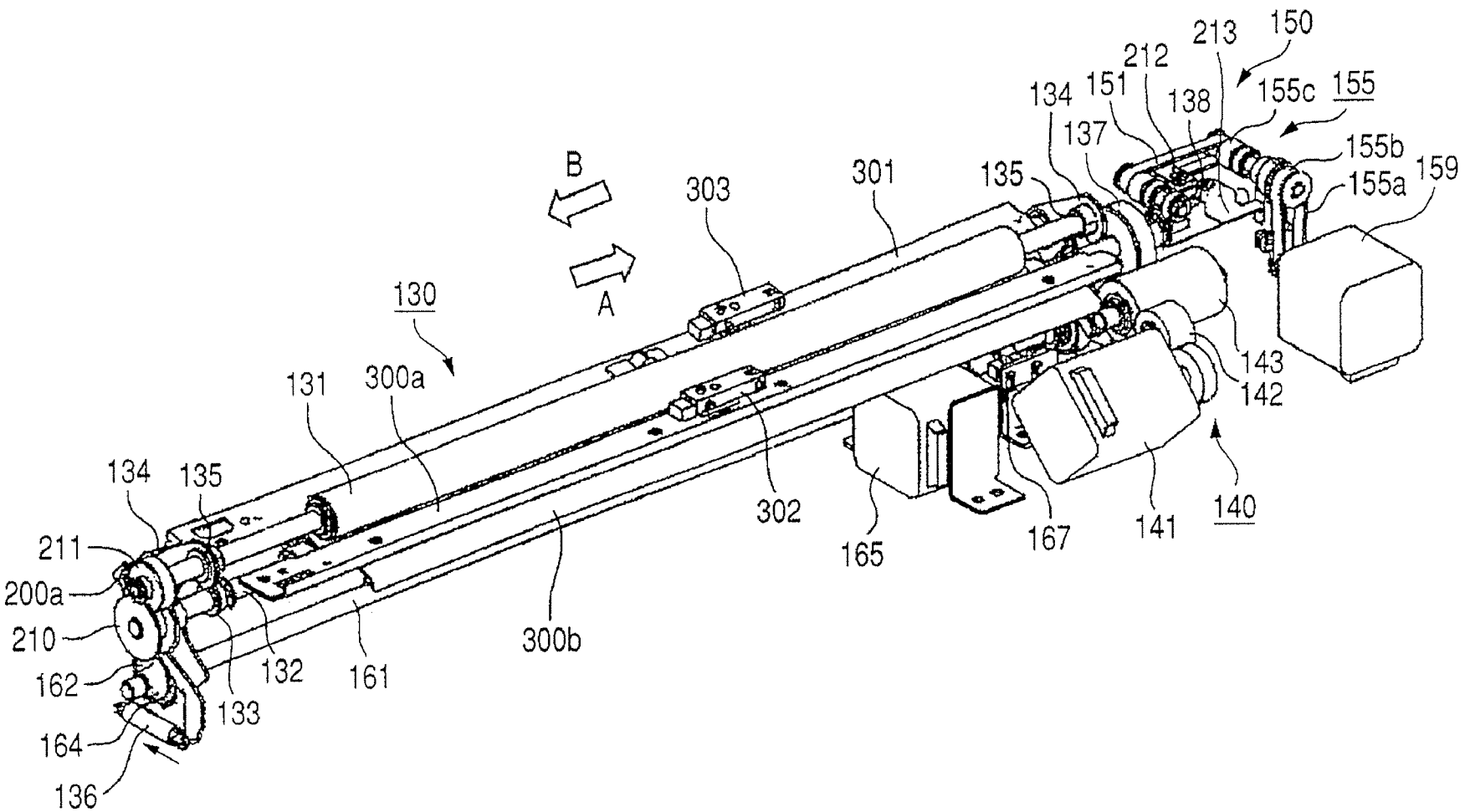
FIG. 3 is a perspective view of a registration roller portion provided in the registration unit.

The registration roller portion 130 serves to convey the sheet having had its skew feed corrected to the secondary transferring portion at predetermined timing, and is comprised of an upper registration roller 131 and a lower registration roller 132, as shown in FIG. 3.

The lower registration roller 132 is supported for sliding movement in the axial direction thereof and rotation by a slide bearing 133 fixed to the frame 200 (see FIG. 2). Also, the upper registration roller 131 is slidably and rotatably supported by a slide bearing 133 fixed onto a pressure arm 134. The pressure arm 134 is rotatably fixed to a shaft 200*a* formed on the frame 200, and is biased in the direction indicated by the arrow in FIG. 3 by a tension spring 136 to thereby bring the upper registration roller 131 into pressure contact with the lower registration roller 132.

A registration roller gear 137 is fixed to the lower registration roller 132, and the drive from a registration roller driving portion 140 is transmitted to the lower registration roller 132 through this registration roller gear 137.

This registration roller driving portion 140 is provided with a motor 141 fixed to the frame 200, and drive gears 142 and 143 for transmitting the drive of the motor 141 to the registration roller gear 137. Also, the drive gear 143 meshing with the registration roller gear 137 has the length of its tooth surface so that the meshing engagement thereof may not be released even if the registration roller gear 137 performs its sliding operation with the axial sliding of the lower registration roller 132 which will be described later. Further, the motor 141 rotates in a counter clockwise direction as viewed from a plane to which the motor 141 is mounted.

Also, one end portion of the lower registration roller 132 is rotatably held by a holder 138, which is supported for movement in the axial direction thereof by a bearing. This holder 138 has mounted thereon a sensor flag 213 for detecting the home position (HP) of the pair of registration rollers 131 and 132 in the main scanning direction.

This holder 138 is fixed to a timing belt 151 by a stopper 212 and a screw. Thereby, when the timing belt 151 is moved in a direction orthogonal to the conveyance direction of the sheet by the drive from the registration roller driving portion 140, the lower registration roller 132 is adapted to be moved integrally with the holder 138.

A runner receiver 210 is fixed to the other end portion of the lower registration roller 132, and a runner 211 fixed to the upper registration roller 131 is engaged with this runner receiver 210. Thereby, when the lower registration roller 132 is moved following the operation of the timing belt 151, the upper registration roller 131 and the lower registration roller 132 can be reciprocally moved in the direction orthogonal to the conveyance direction of the sheet in synchronism with each other.

Upstream of the pair of registration rollers 131 and 132 with respect to the conveyance direction of the sheet, there are provided an entrance upper guide 300*a* and an entrance lower guide 300*b* for receiving the sheet having had its skew feed corrected by a obliquely feed roller guide portion 100 which will be described later. Also, downstream of the pair of registration rollers 131 and 132 with respect to the conveyance direction of the sheet, an exit guide 301 is fixed to the frame 200. Further, the entrance upper guide 300*a* and the exit guide 301 are provided with sheet detecting sensors 302 and 303, respectively.

The registration roller slide portion 150 is comprised of a slide motor 159, a timing belt 155*a* and pulleys 155*b* and 155*c*, and is provided with a driving train 155 for transmitting the drive of the slide motor 159 to the timing belt 151. The slide motor 159 is fixed to a motor stand 152 shown in FIG. 2 and is screwed to a motor supporting plate 153.

When the slide motor 159 is, for example, clockwise rotated, this rotation is transmitted to the timing belt 151 through the driving train 155. Thereby, together with the holder 138, the pair of registration rollers 131 and 132 slide in the direction indicated by the arrow A in FIG. 3, and the sheet offset to correct the aforedescribed skew feed is returned to the central conveyance reference position. When the slide motor 159 has been counterclockwise rotated, the pair of registration rollers 131 and 132, together with the holder 138, are moved in the direction indicated by the arrow B in FIG. 3.

The registration roller pressure releasing portion 160 is for releasing the pressure contact between the pair of registration rollers 131 and 132, and is constituted by a pressure releasing shaft 161 supported by a bearing positioned on the frame 200, and a releasing cam 162 fixed to the pressure releasing shaft 161. The pressure releasing shaft 161 is driven by a registration releasing motor 165.

Here, a deep groove ball bearing 164 is forced into the releasing cam 162 at a position eccentric from the rotation center thereof, and when the releasing shaft 161 is caused to make one full rotation, pressurization and release can be effected each one time by the action of the contact and separation of the deep groove ball bearing 164.

Also, a sensor flag (not shown) is mounted on the pressure releasing shaft 161, and the phase of the pressure releasing shaft 161 is detected by a detecting sensor 167 positioned on and fixed to a sensor supporting plate fixed to the frame 200 to thereby control the rotation of the registration releasing motor 165. The phase of the releasing cam 162 is determined so as to shield the detecting sensor 167 when a sensor flag pressurizing operation is being performed.

The obliquely feed roller guide portion 100 which is a first guide portion (movement guide portion) in the present embodiment is constituted by a base portion 101, a lower guide portion 102, an upper guide portion 103 and a hinge portion 104, as shown in FIG. 4. FIG. 4 shows a state in which the upper guide portion 103 has been separated from the base portion 101. This upper guide portion 103 is adapted to fit the rotation center shaft 106 of the hinge portion 104 usually fixed onto the base portion 101 into an aperture 107*a* in an arm 107, to thereby be held on the base portion 101 for pivotal movement in a vertical direction.

On the lower guide 102, obliquely feed rollers 253, 254 and 255 made of rubber which are obliquely feed means driven by a motor (not shown) and obliquely feeding the sheet are disposed at an angle inclined at θ (deg) with respect to the conveyance direction of the sheet indicated by the arrow C. Also, this lower guide 102 is provided with a side regulating plate 105 provided with a reference wall 105*a* which is a reference guide extending in the conveyance direction of the sheet which constitutes skew feed correcting mans together with the obliquely feed rollers 253, 254 and 255. The sheet S, when conveyed by the obliquely feed rollers 253, 254 and 255, strikes against the reference wall 105*a* provided on the side regulating plate 105, whereby it is conveyed while its skew feed is corrected.

Also, runner pressure units 260, 261 and 262 provided with pressure runners 271, 272 and 273 which are rotatable idler runners, and releasing motors 263, 264 and 265, respectively, are fixed onto the upper guide 103.

Here, these releasing motors 263, 264 and 265 are for effecting the changeover of the contact (pressurized) state and the non-contact state of the pressure runners 271, 272 and 273 on the respective obliquely feed rollers 253, 254 and 255. In the present embodiment, the release of the contact of the pressure runners 271, 272 and 273 takes place at a point of time whereat the leading edge of the sheet S has been nipped between the registration rollers, and the contact thereof takes place before the trailing edge of the sheet leaves the pressure runners 271, 272 and 273 and the next sheet arrives.

Figure 5:
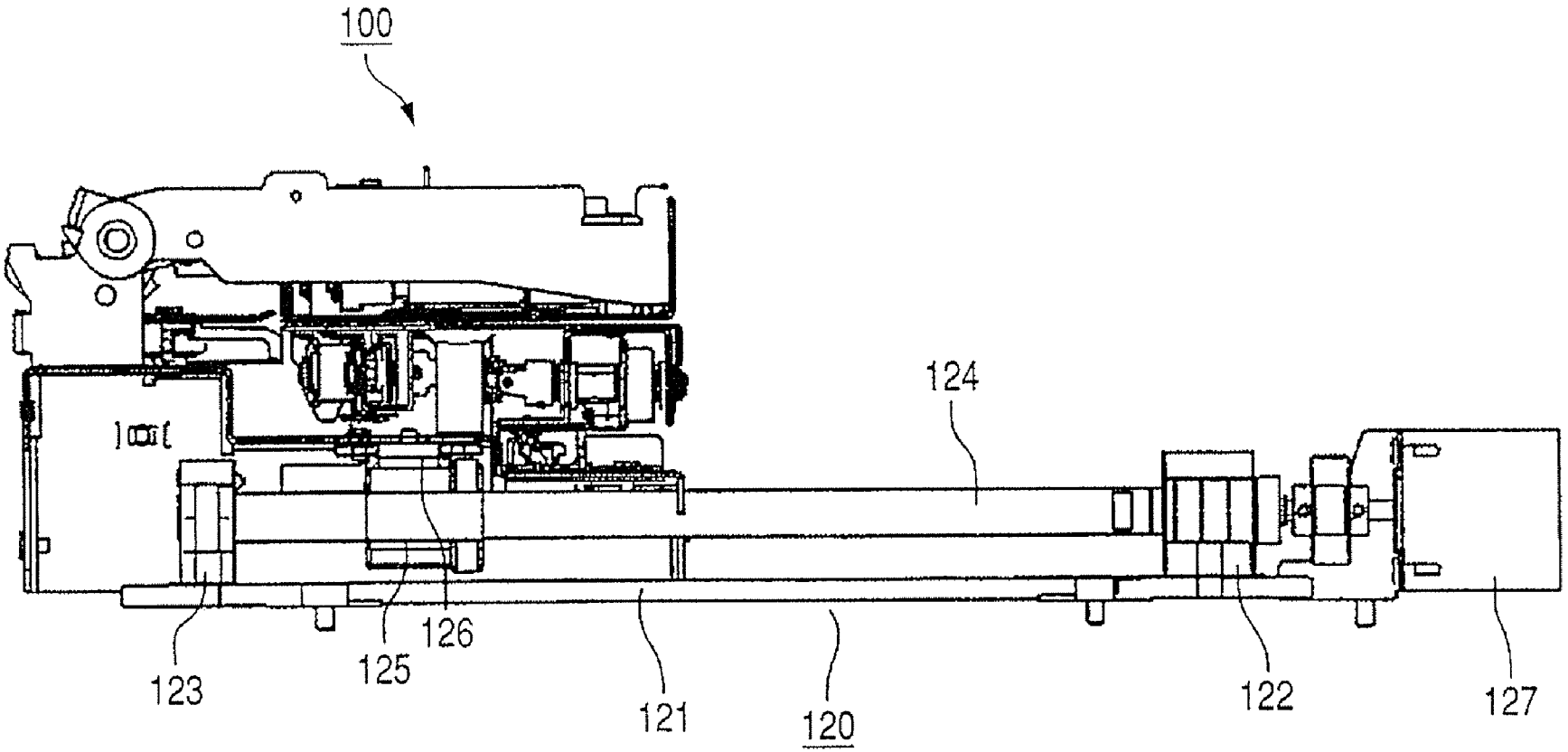
FIG. 5 is a side view of a obliquely feed guide moving driving portion provided in the registration unit.

The obliquely feed guide moving driving portion 120 is for effecting the positioning of the obliquely feed roller guide portion 100. This obliquely feed guide moving driving portion 120, as shown in FIG. 5, is provided with a base portion 121, a first bearing stand 122 and a second bearing stand fixed to the base portion 121, and a lead screw 124 rotatably supported by the first and second bearing stands 122 and 123. The base portion 121 is fixed to the frame 200.

Also, a nut 125 sliding in accordance with the rotation of the lead screw 124 is provided on the lead screw 124, and further a bracket 126 is mounted on this nut 125. The nut 125 and the obliquely feed roller guide portion 100 are connected together by this bracket 126.

Also, a drive motor 127 which is a stepping motor is connected to one end of the lead screw 124, and changes its driving pulse number in accordance with the size of the sheet, and effects the positioning of the obliquely feed roller guide portion 100.

Figure 6:
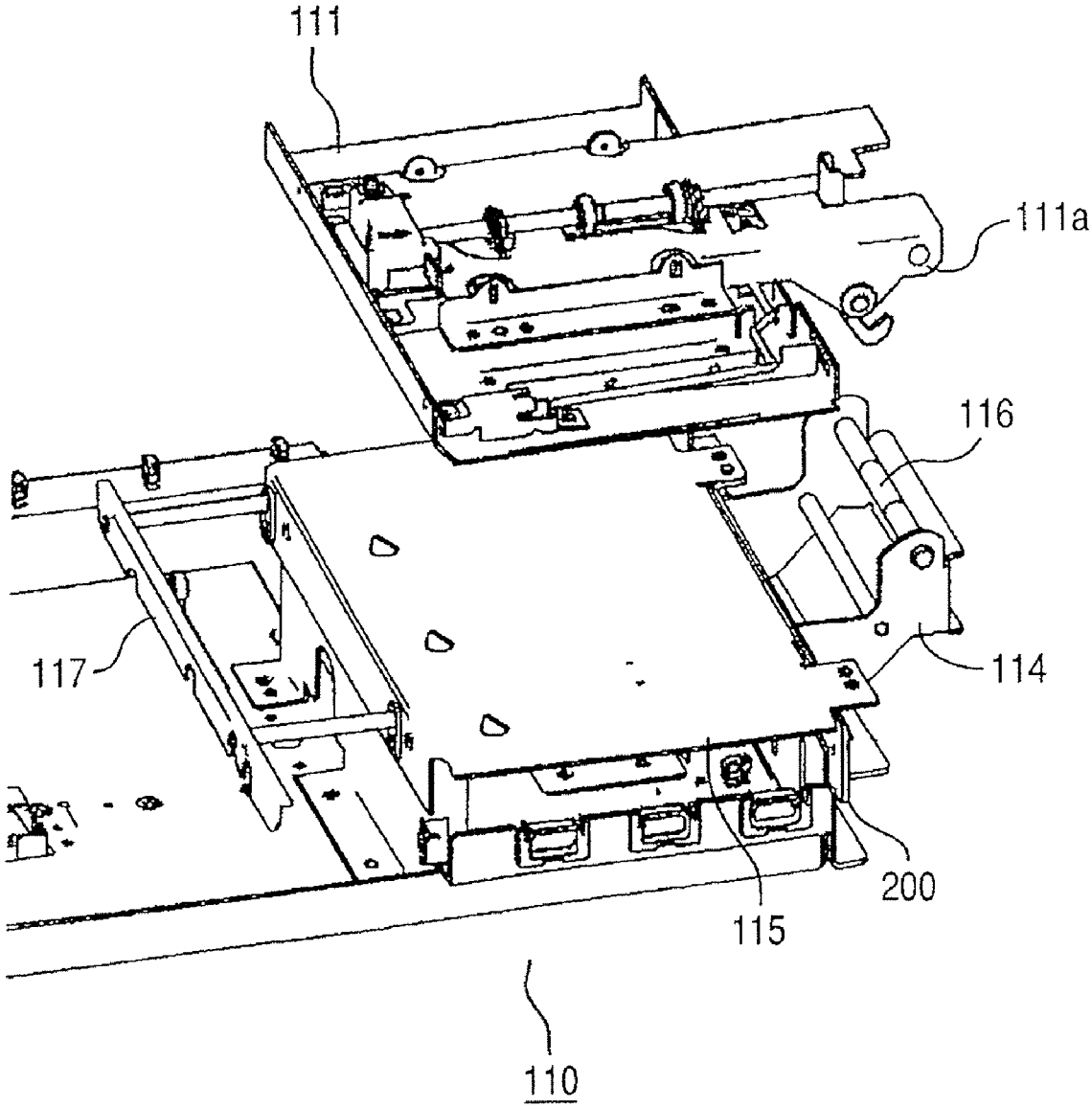
FIG. 6 is a perspective view of a fixed guide portion provided in the registration unit.

A fixed guide portion 110 which is a second guide portion in the present embodiment, as shown in FIG. 6, is constituted by a fixed lower guide 115 fixed to the frame 200, a hinge stand 114 fixed to the frame 200, and a fixed upper guide portion 111. Here, this fixed upper guide portion 111 is adapted to be held on the hinge stand 114 for pivotal movement in a vertical direction. FIG. 6 shows a state in which the fixed upper guide portion 111 has been separated.

Description will now be made of the operation of the thus constructed registration unit 30.

Before the sheet is conveyed, the position of the obliquely feed roller guide portion 100 is adjusted by the obliquely feed guide moving driving portion 120 so that the reference wall 105*a* may come to a position offset in advance by a predetermined amount (F mm) from a sheet conveyance reference position in accordance with the width of the sheet S being conveyed.

Next, the sheet fed in by the sheet conveying apparatus 20 is nipped and conveyed by the obliquely feed rollers 253, 254, 255 and the pressure runners 271, 272, 273 shown in FIG. 4, and is obliquely fed toward the reference wall 105*a* at an angle θ (deg), and one side edge of the sheet abuts against the reference wall 105*a*. When the sheet has been nipped by the obliquely feed rollers 253, 254, 255 and the pressure runners 271, 272, 273, the roller of the conveying roller portion 20A of the sheet conveying apparatus 20 is pressure-released by a pressure releasing mechanism (not shown).

Next, the sheet abutting against the reference wall 105*a* is fed to the pair of registration rollers 131 and 132. Thereafter, the sheet is fed by a predetermined amount, whereupon a pressure releasing operation of the pressure runners 271, 272 and 273 opposed to the obliquely feed rollers 253, 254 and 255, respectively, to the obliquely feed roller 253 is performed by runner pressure units 260, 261 and 262.

Further, at a stage whereat such a pressure releasing operation of the pressure runners 271, 272 and 273 has been completed, the slide motor 159 of the registration roller slide portion 150 is rotated in the clockwise direction to thereby move the pair of registration rollers 131 and 132 in the direction indicated by the arrow A in FIG. 3 already described (the amount of movement in F mm). Thereby, the sheet having had its skew feed corrected by the reference guide 105*a* at a position deviating outwardly from the sheet conveyance reference can be made coincident with a regular sheet conveyance reference position.

Next, when the sheet S is fed to the secondary transfer outer roller 44, the pair of registration rollers 132 and 133 are pressure-released by a registration roller pressure releasing portion 160. Also, when the trailing edge of the sheet passes between the pair of registration rollers 131 and 132, the slide motor 151 is rotated in the clockwise direction to prepare for the next sheet, and the pair of registration rollers 131 and 132 are moved in the direction indicated by the arrow B in FIG. 3 already described (the amount of movement is F mm). Further, after the completion of the movement of the pair of registration rollers 131 and 132, a pressure releasing operation is performed by the registration roller pressure releasing portion 160.

Figure 7:
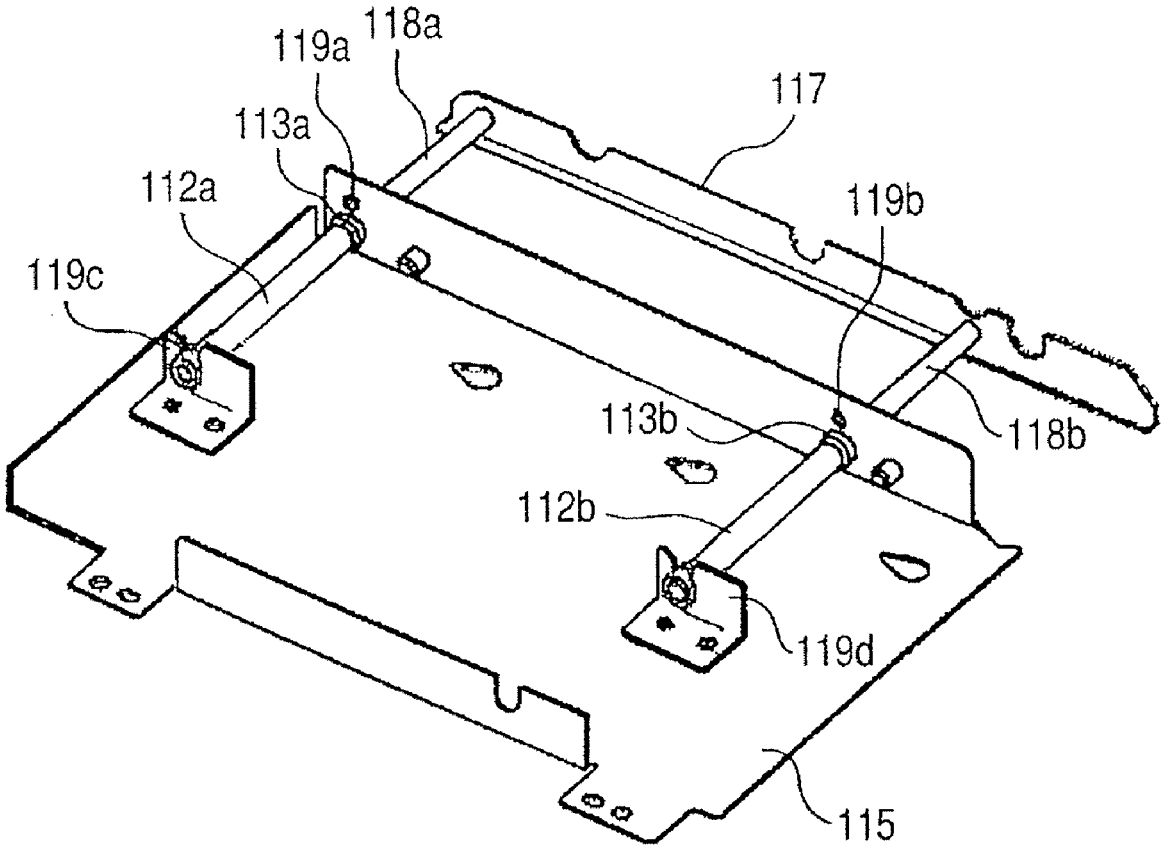
FIG. 7 is a perspective view of the back side of the fixed guide portion.

As shown in FIG. 6, an auxiliary guide 117 which is an essential construction of the present invention is provided on the fixed lower guide 115 for sliding to the obliquely feed roller guide portion 100 side. Here, this auxiliary guide 117 has two shafts 118*a* and 118*b* fixed thereto as shown in FIG. 7 which is a view of the fixed lower guide 115 as it is seen from its back.

These two shafts 118*a* and 118*b* are slidably supported by bearings 119*a* to 119*d* fixed onto the fixed lower guide 115. Also, they are biased toward the center by springs 112*a* and 112*b* through E rings 113*a* and 113*b*, and the E rings 113*a* and 113*b* are adapted to be protruded to and stopped at a predetermined position whereat they contact with a side of the fixed lower guide 115.

Figure 8:
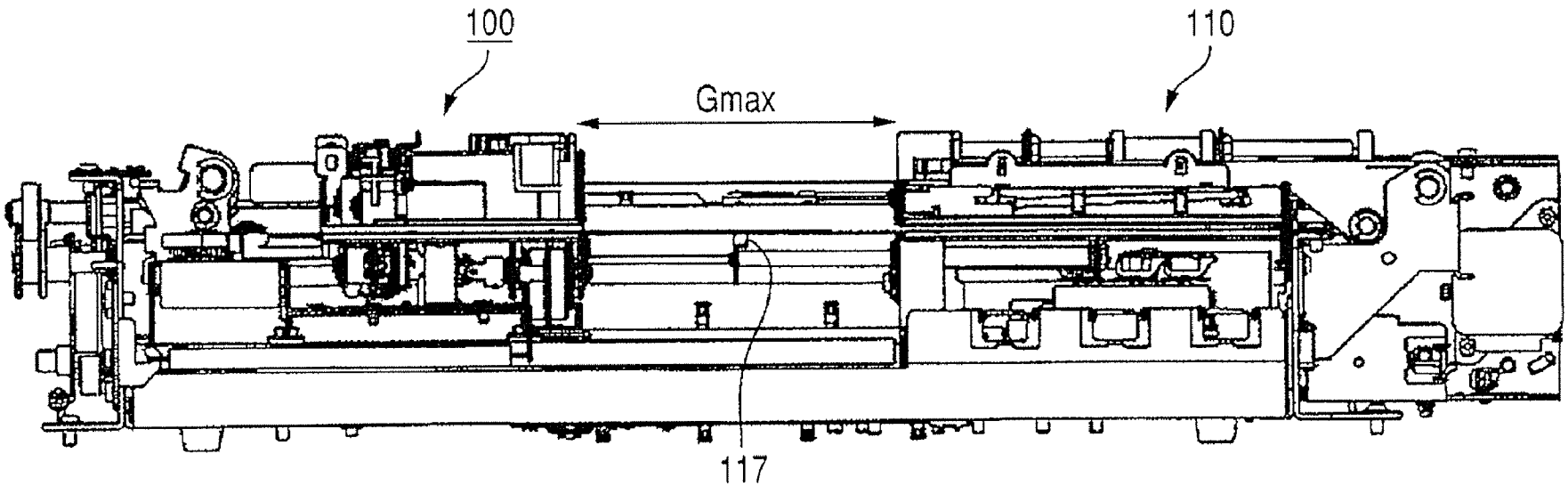
FIG. 8 is a side view of the registration unit showing a state when it conveys a sheet of a maximum size.

This stop position is substantially the center of the guide gap Gmax between the fixed guide portion 110 and the obliquely feed roller guide portion 100 in the width direction during the conveyance of a sheet of a maximum size, as shown in FIG. 8. Here, the auxiliary guide 117 is thus protruded to substantially the center of the guide gap Gmax, whereby the sheet can be guided while the central portion of the sheet being conveyed is supported from below it by the auxiliary guide 117, and the central portion of the sheet can be prevented from being downwardly flexed.

Figure 9:
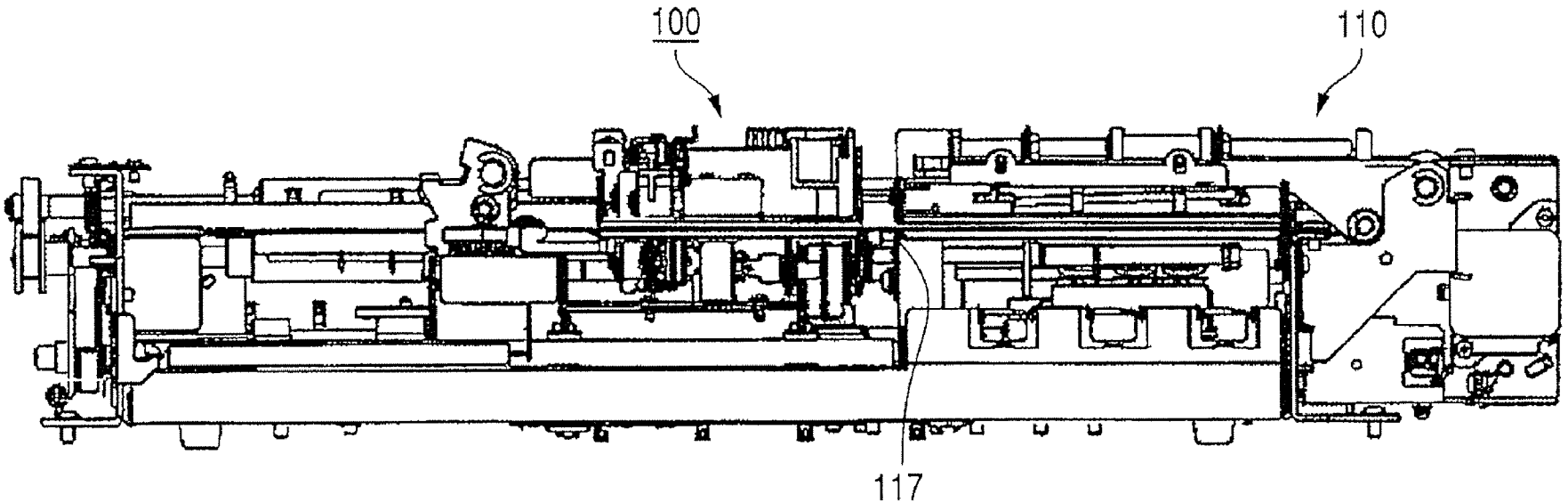
FIG. 9 is a side view of the registration unit showing a state when it conveys a sheet of a minimum size.

FIG. 9 represents the state during the conveyance of a sheet of a minimum size, and at this time, the obliquely feed roller guide portion 100 has been moved from its position shown in FIG. 8 to the fixed guide portion 110 side. When the obliquely feed roller guide portion 100 is thus moved, the obliquely feed roller guide portion 100 is moved while pushing the auxiliary guide 117 toward the fixed lower guide 115 against the forces of the springs 112*a* and 112*b*. Thereby, the obliquely feed roller guide portion 100 can be moved without being hindered by the auxiliary guide 117.

Also, when the obliquely feed roller guide portion 100 is moved from the position during the conveyance of the sheet of the minimum size shown in FIG. 9 to the position during the conveyance of the sheet of the maximum size shown in FIG. 8, this auxiliary guide 117 is returned to substantially the center of the guide gap Gmax shown in FIG. 8 by the springs 112*a* and 112*b*.

Figure 10B:
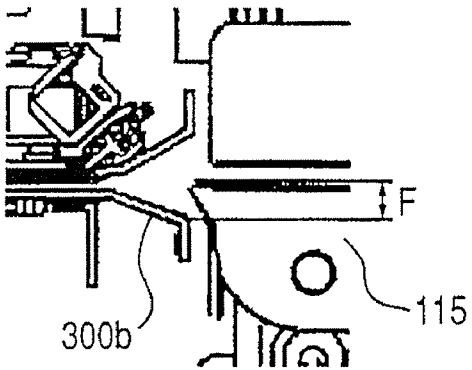
FIG. 10B is an enlarged view of a portion 10B encircled by the circle of FIG. 10A.
Figure 10A:
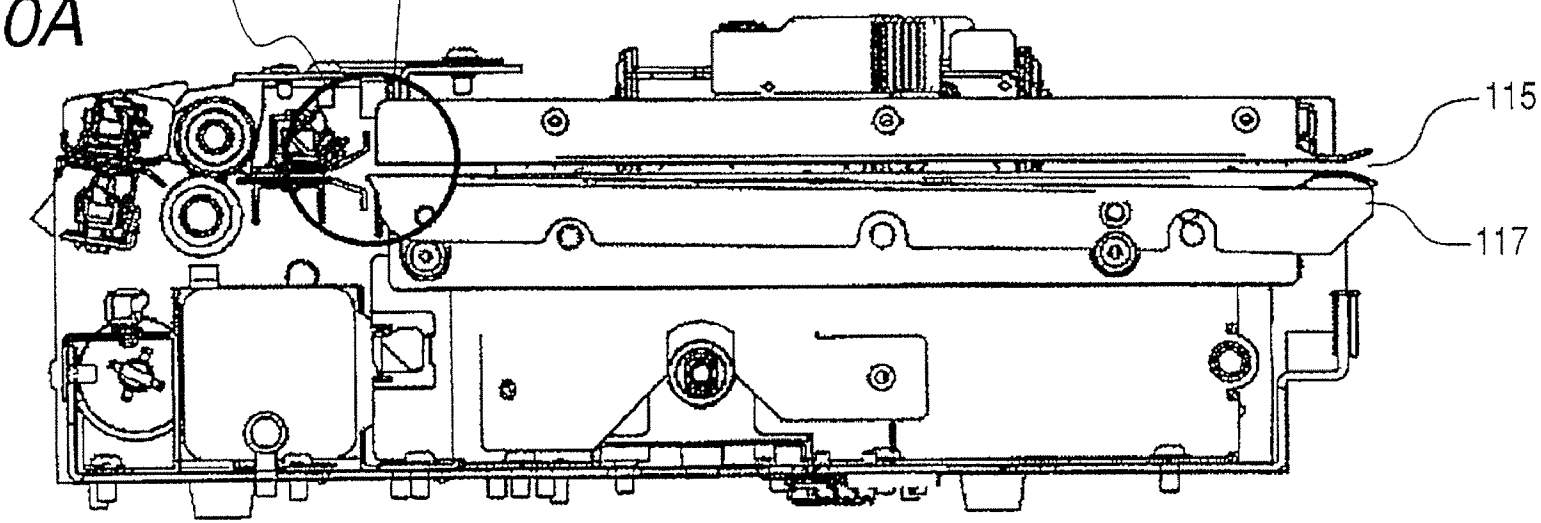
FIG. 10A is a cross-sectional view of the registration unit.

Now, the height of the auxiliary guide 117 on the entrance side with respect to the conveyance direction of the sheet is lower than the fixed lower guide 115 of the fixed guide portion 110 (and the lower guide portion 102 of the obliquely feed roller guide portion 100), as shown in FIGS. 10A and 10B. Thereby, the leading edge portion of the sheet can be prevented from being caught by the auxiliary guide 117 when the sheet is conveyed from the sheet conveying apparatus 20 to the registration unit 30.

Figure 11A:
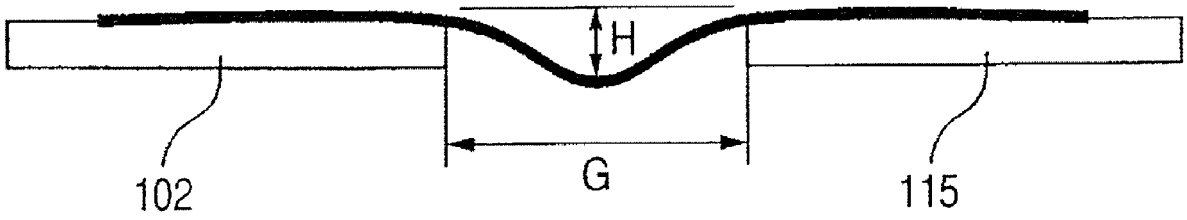
FIG. 11A shows the guide interval between the fixed guide portion and obliquely feed roller guide portion of the registration unit and the pendent amount of the sheet.
Figure 11B:
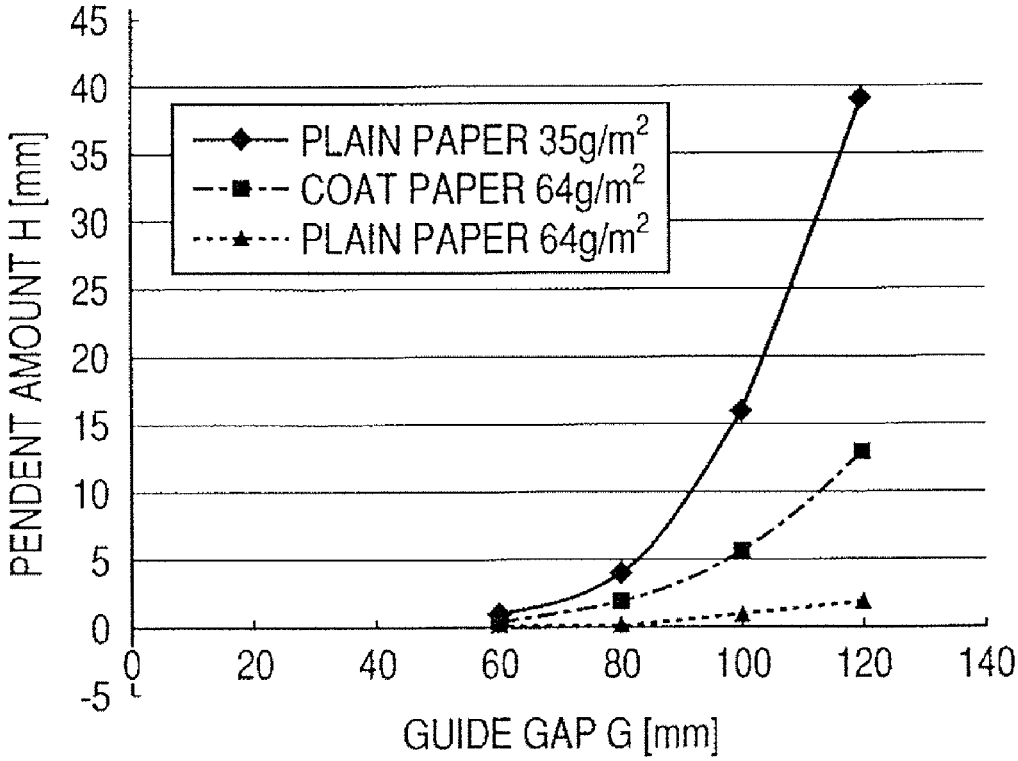
FIG. 11B represents the relation between the guide interval and the pendent amount of the sheet.

FIG. 11B shows the relation between the guide gap G and the flexure amount H of the central portion of the sheet when the sheet S is placed on the fixed lower guide 115 of the fixed guide portion 110 and the lower guide portion 102 of the obliquely feed roller guide portion 100, in accordance with the kind of the sheet.

Here, generally a sheet having a great basis weight is thicker and greater in stiffness and therefore, becomes small in the flexure amount H even if the guide gap is great, but coat paper of even the same basis weight is weak in stiffness and great in the flexure amount H. Also, even a considerably thin sheet of plain paper having a basis weight of 35 g/m$^2$ is of the order of 1 mm in the flexure amount H for a guide gap of 60 mm, and becomes very little different from the other sheets.

In the present embodiment, the heights of the obliquely feed roller guide 102 and the fixed lower guide 115 are the same, and the difference F thereof in the height direction from a registration roller entrance lower guide 300*b* shown in FIG. 10B is 5 mm. Therefore, if the guide gap is set to 80 mm or less, the sheet will not be caught by the registration roller lower guide 300*b* even if the sheet is downwardly flexed, and jam will not occur. Also, the sheet of the minimum size of 139 mm, and the guide gap G in that case is 7.5 mm.

On the other hand, the sheet of the maximum size is 364 mm, and the guide gap G at this time is 120 mm, and in this case, as shown in FIG. 11A, the sheet comes to be downwardly flexed. So, when in the present embodiment, the sheet of the maximum size is to be conveyed, the auxiliary guide 117 is adapted to be most protruded in accordance with the size of the sheet. Specifically, the protruded position of this auxiliary guide 117 is at 56 mm from the fixed lower guide 115 which is substantially the center of the guide gap G which is the setting with a surplus relative to 80 mm. The width of the auxiliary guide 117 is 5 mm.

As described above, when the sheet passes through the sheet conveying path R1 of the registration unit 30, the obliquely feed roller guide portion 100 regulating the position of one side edge of the sheet by the skew feed correcting portion is moved in advance to a position corresponding to the size of the sheet, and in operative association with the movement of the obliquely feed roller guide portion 100, the auxiliary guide 117 is moved to a guide position corresponding to the size of the sheet, whereby the sheet can be prevented from being downwardly flexed in the guide gap G. Thereby, the sheet can be conveyed with its skew feed corrected without jam or bending occurring to the sheet.

Figure 12:
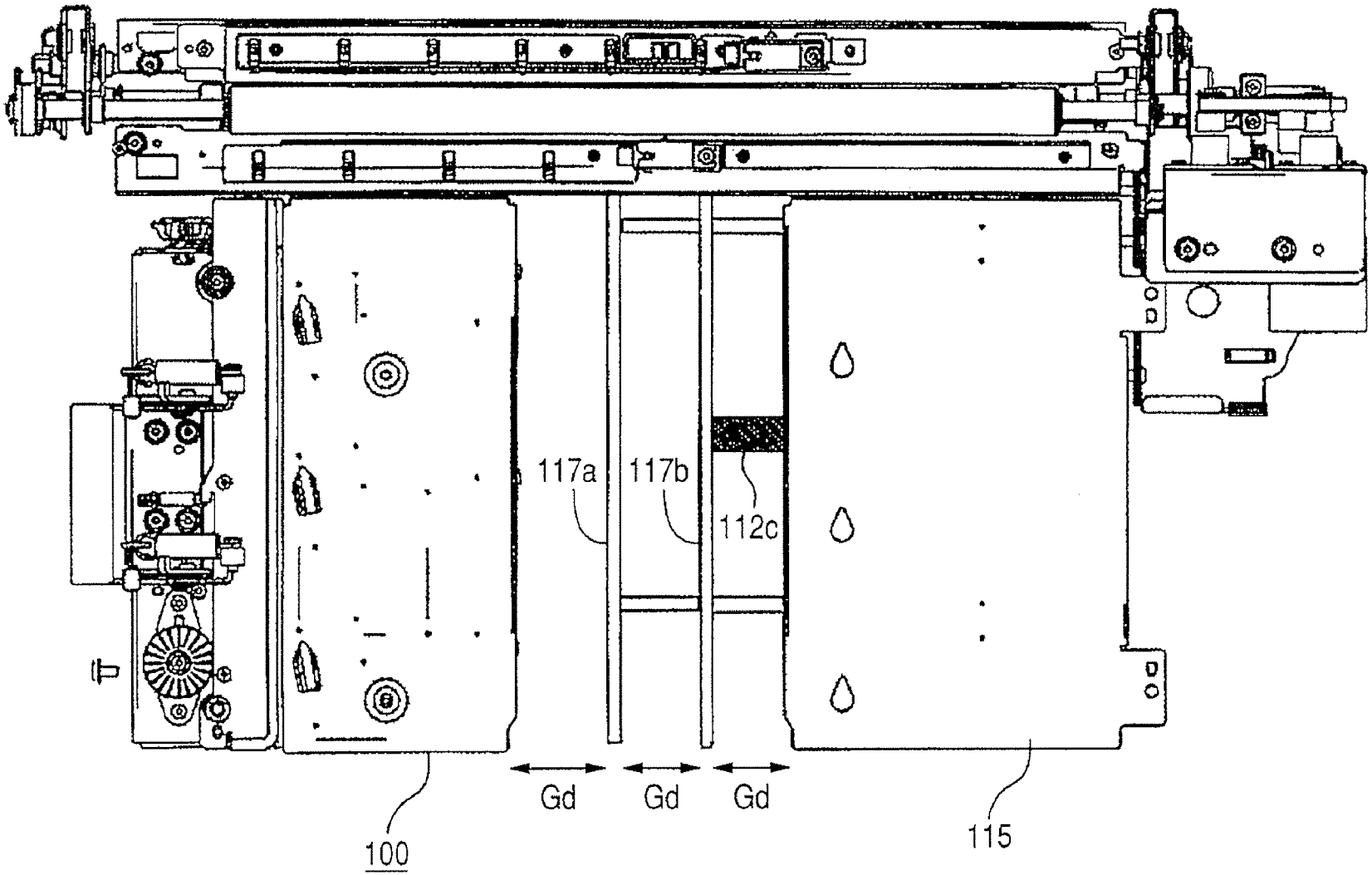
FIG. 12 is a top plan view illustrating another construction of an auxiliary guide provided in the registration unit.

In a case where the difference between the sheet of the maximum size and the sheet of the minimum size is great and the flexure of the sheet cannot be prevented against the guide gap G by the single auxiliary guide 117, provision may be made of a plurality of auxiliary guides, e.g. two auxiliary guides 117*a* and 117*b* as shown in FIG. 12.

Here, these two auxiliary guides 117*a* and 117*b* are set so as to assume a substantially uniform interval Gd during the conveyance of the sheet of the maximum size. Also, one auxiliary guide 117*b* is biased toward the center by a spring 112*c* other than a spring for the other auxiliary guide 117*a*, whereby the auxiliary guides 117*a* and 117*b* are pushed into the fixed lower guide 115 side by the movement of the obliquely feed roller guide portion 100.

A second embodiment of the present invention will now be described.

Figure 13:
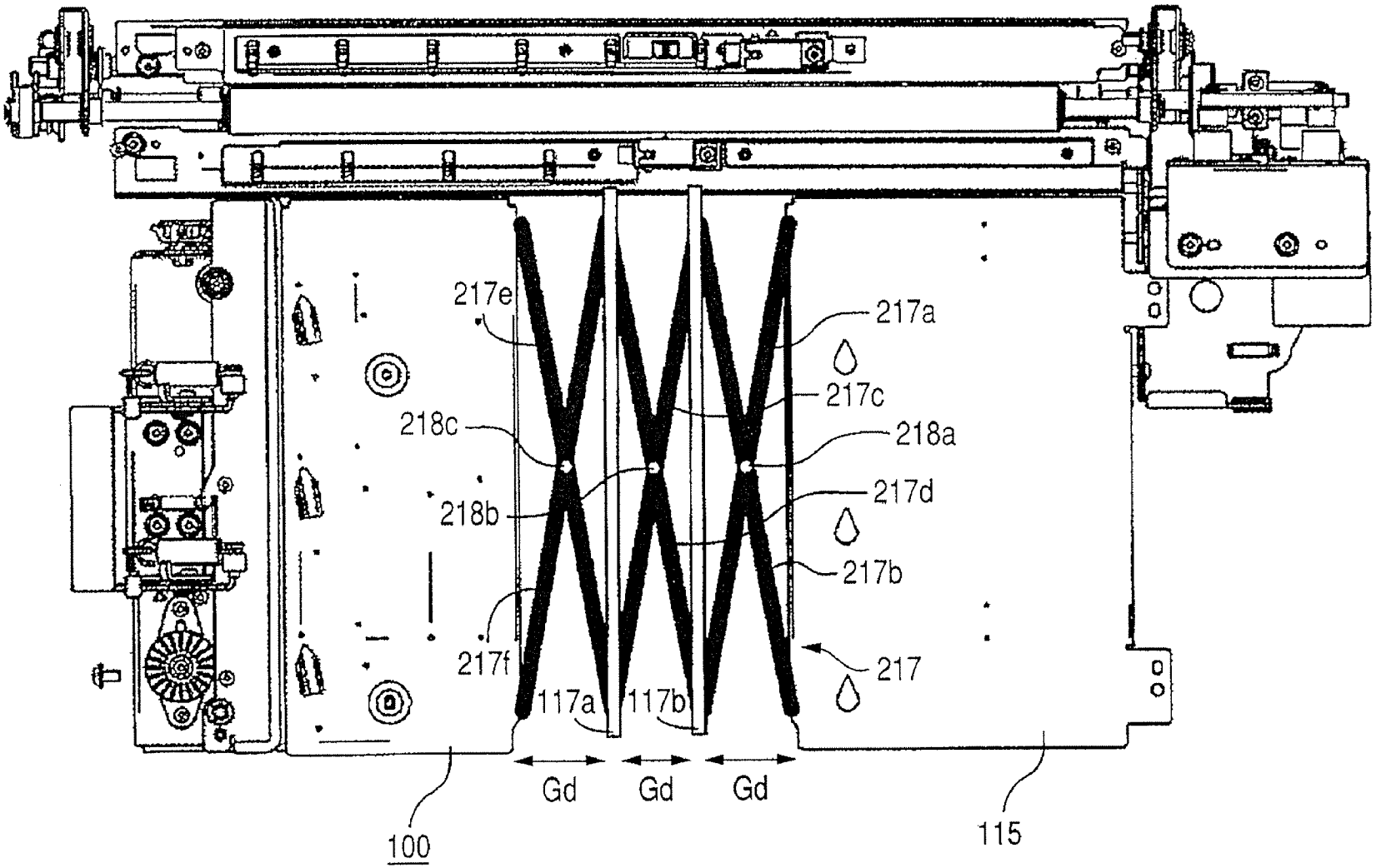
FIG. 13 is a top plan view of a registration unit provided in an image forming apparatus according to a second embodiment of the present invention.

FIG. 13 is a to plan view of a registration unit provided in an image forming apparatus according to the present embodiment. In the present embodiment, two (plural) auxiliary guides 117*a* and 117*b* are provided between a obliquely feed roller guide portion 100 and a fixed guide portion 110, and are adapted to be moved by a link mechanism 217 provided with links 217*a* to 217*f*.

Here, the links 217*a* and 217*b* each having one end thereof pivotally supported by the fixed guide portion 110 have their other end connected to one end of the links 217*d* and 217*c* while being connected together at a central portion 218*a*. Also, the links 217*e* and 217*f* each having one end thereof pivotally supported by the obliquely feed roller guide portion 100 have their other ends connected to the other ends of the links 217*d* and 217*c* while being connected together at a central portion 218*c*.

The auxiliary guides 117*a* and 117*b* are placed on the connected portions of the links 217*a* to 217*f*. Thereby, in operative association with the obliquely feed roller guide portion 100 being moved in accordance with the size of the sheet, the auxiliary guides 117*a* and 117*b* are moved by the link mechanism with the interval Gd therebetween kept uniform, but with the distance therebetween changed. Of course, in a case where a plurality of auxiliary guides are unnecessary, the number of the links may be decreased and a single auxiliary guide may be provided in the central portion.

A third embodiment of the present invention will now be described.

Figure 14:
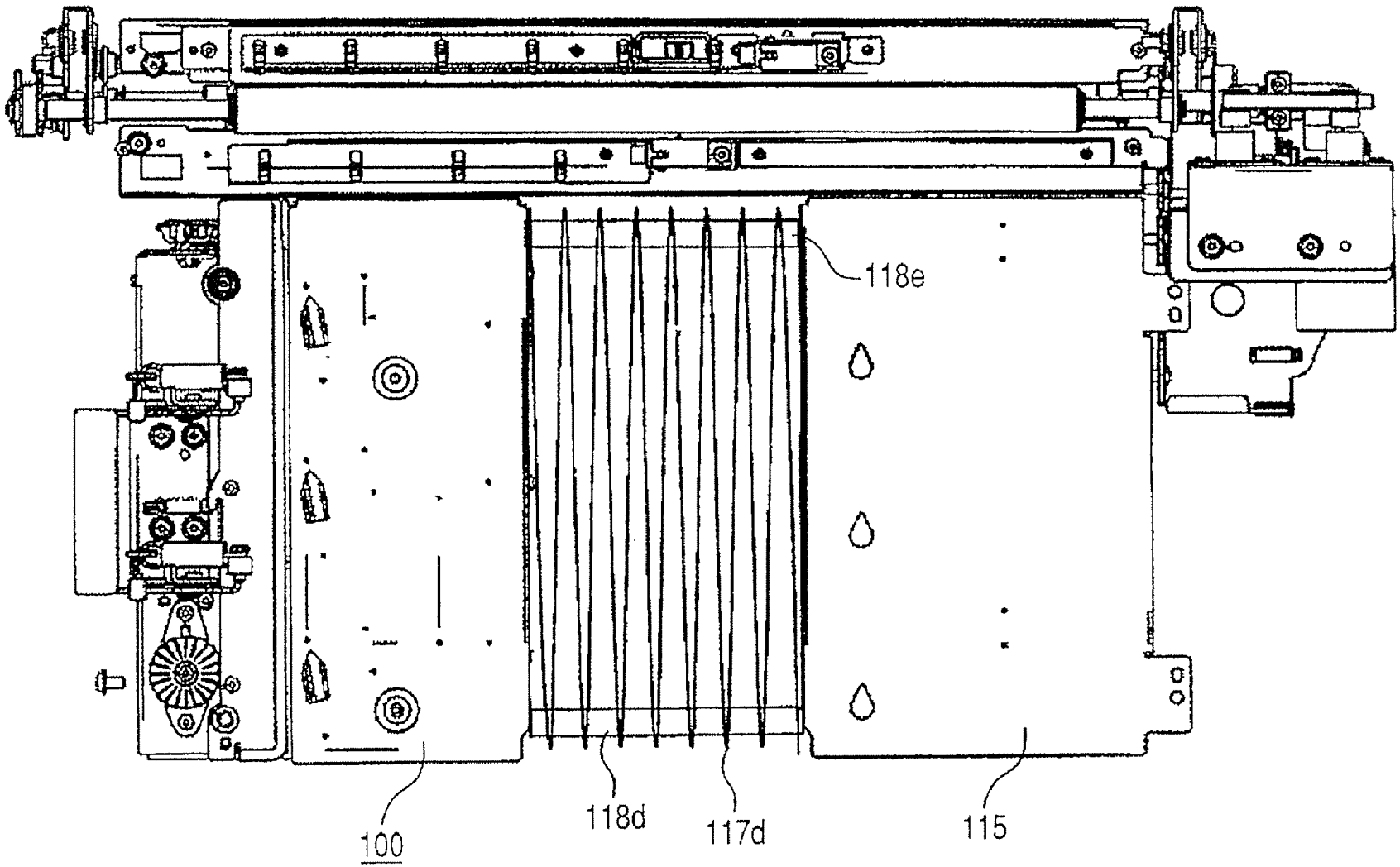
FIG. 14 is a top plan view of a registration unit provided in an image forming apparatus according to a third embodiment of the present invention.

FIG. 14 is a top plan view of a registration unit provided in an image forming apparatus according to the present embodiment. In the present embodiment, the auxiliary guide is formed by an elastically deformable member, e.g. a coil spring 117*d*.

Figure 15:
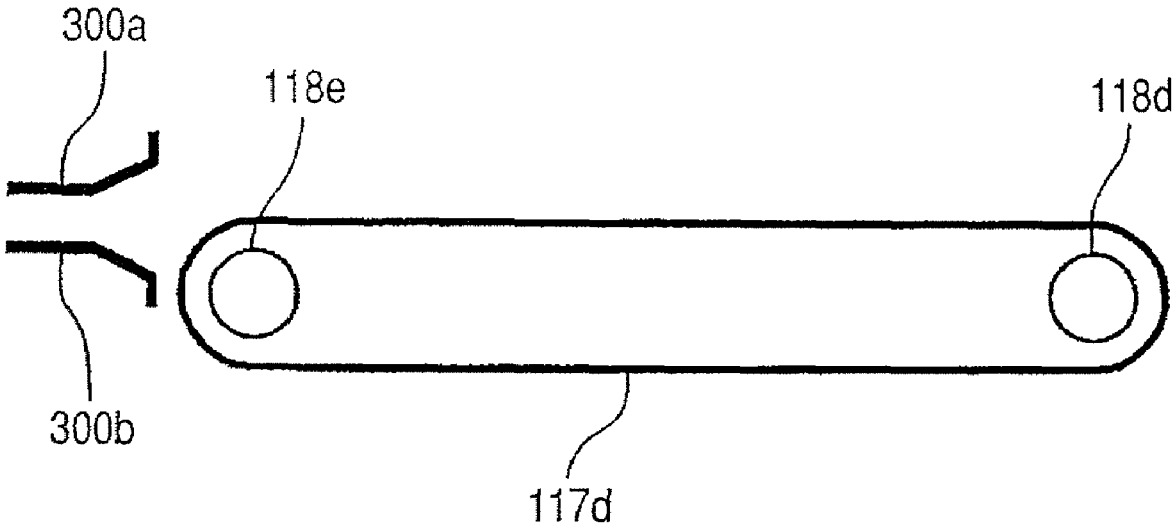
FIG. 15 illustrates the construction of an auxiliary guide provided in the registration unit.
Figure 16:
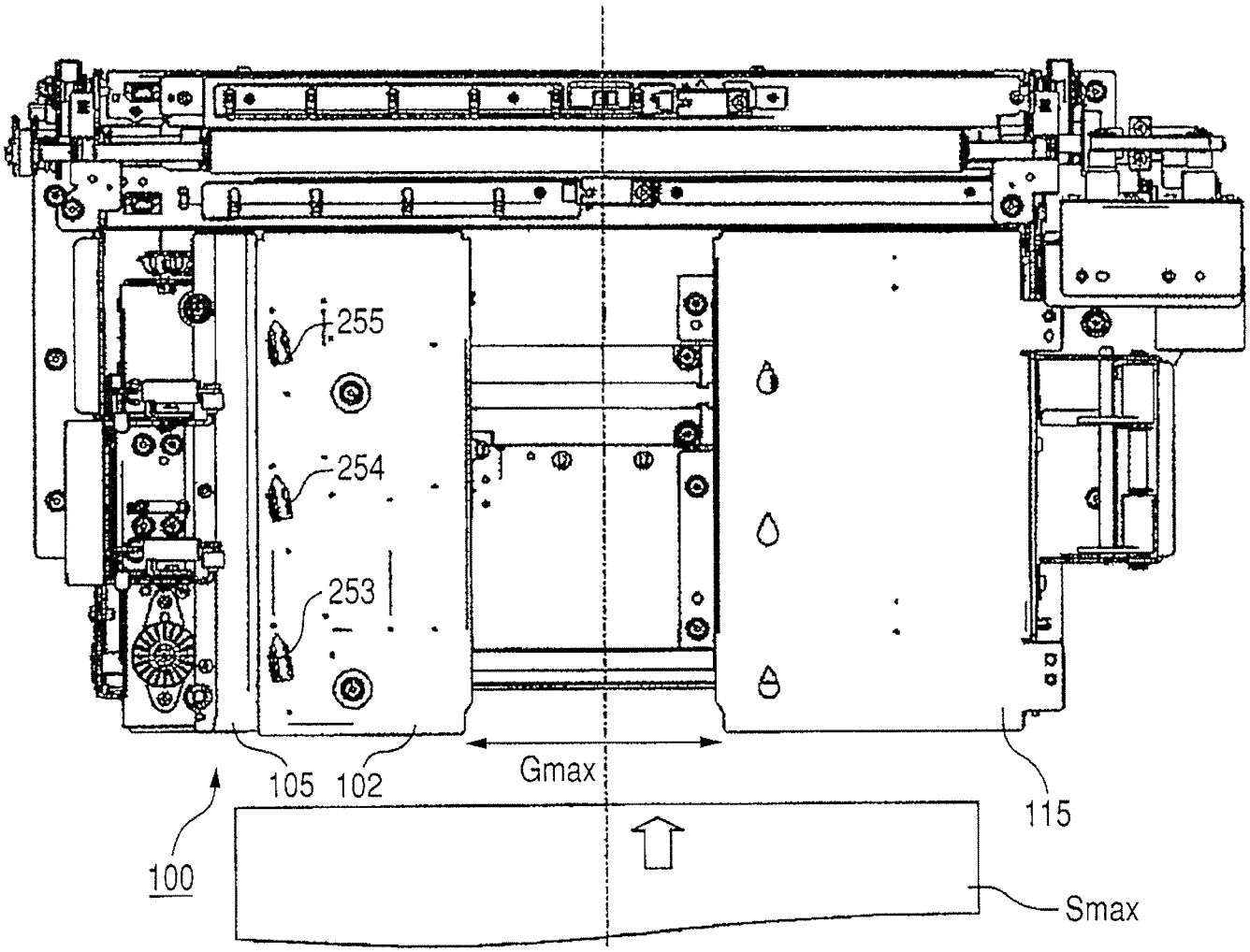
FIG. 16 is a top plan view of a conventional skew feed correcting portion showing a state when it conveys a sheet of a maximum size.
Figure 17:
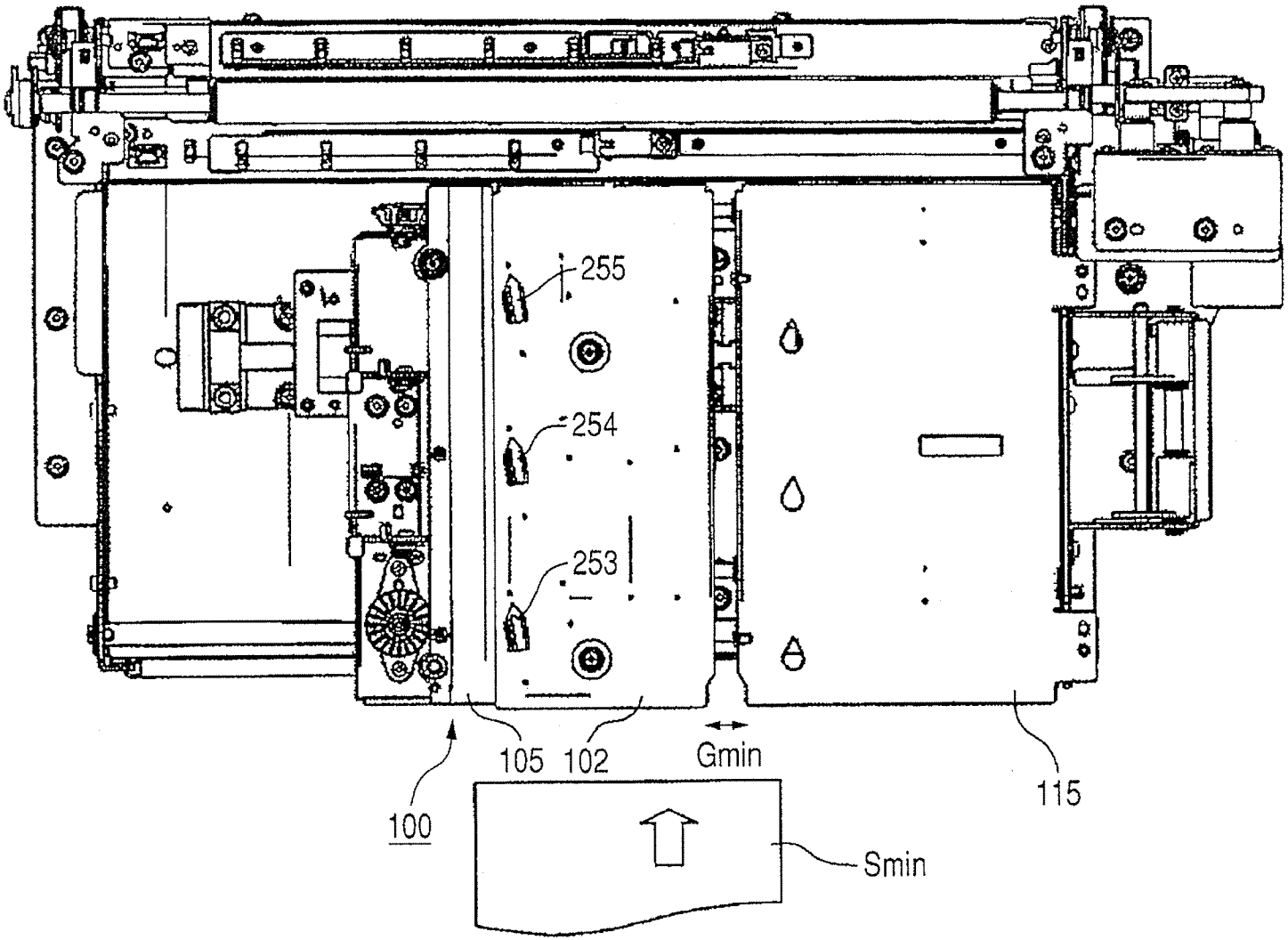
FIG. 17 is a top plan view of the conventional skew feed correcting portion showing a state when it conveys a sheet of a minimum size.
Figure 18:
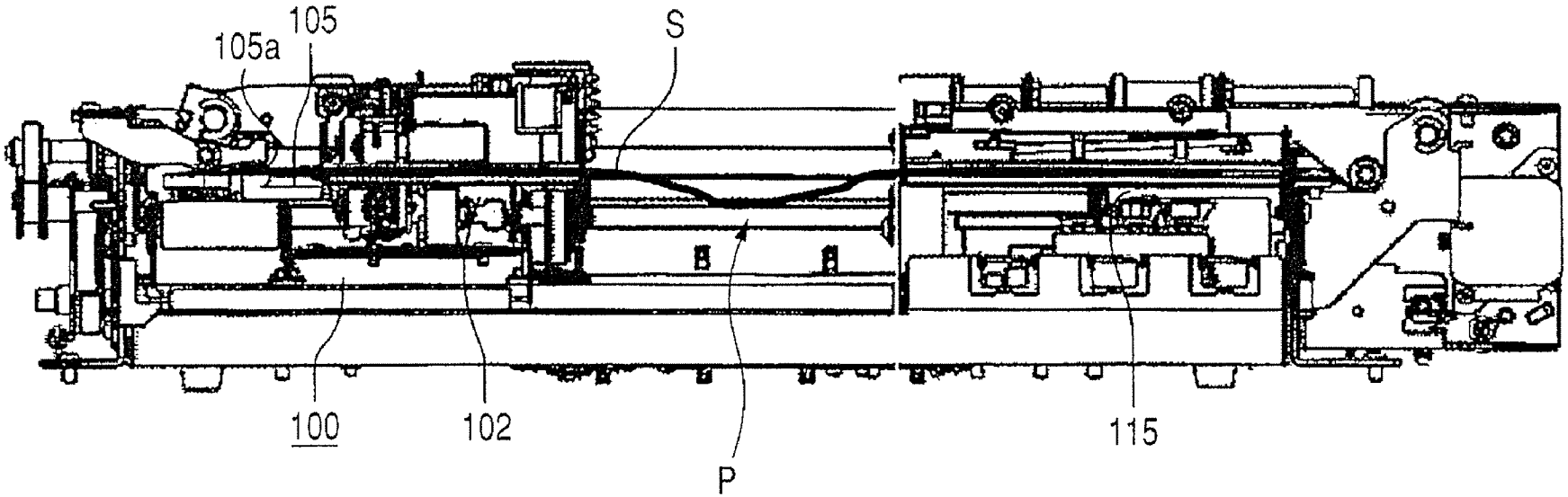
FIG. 18 illustrates an inconvenience peculiar to the conventional skew feed correcting portion.
Figure 19:
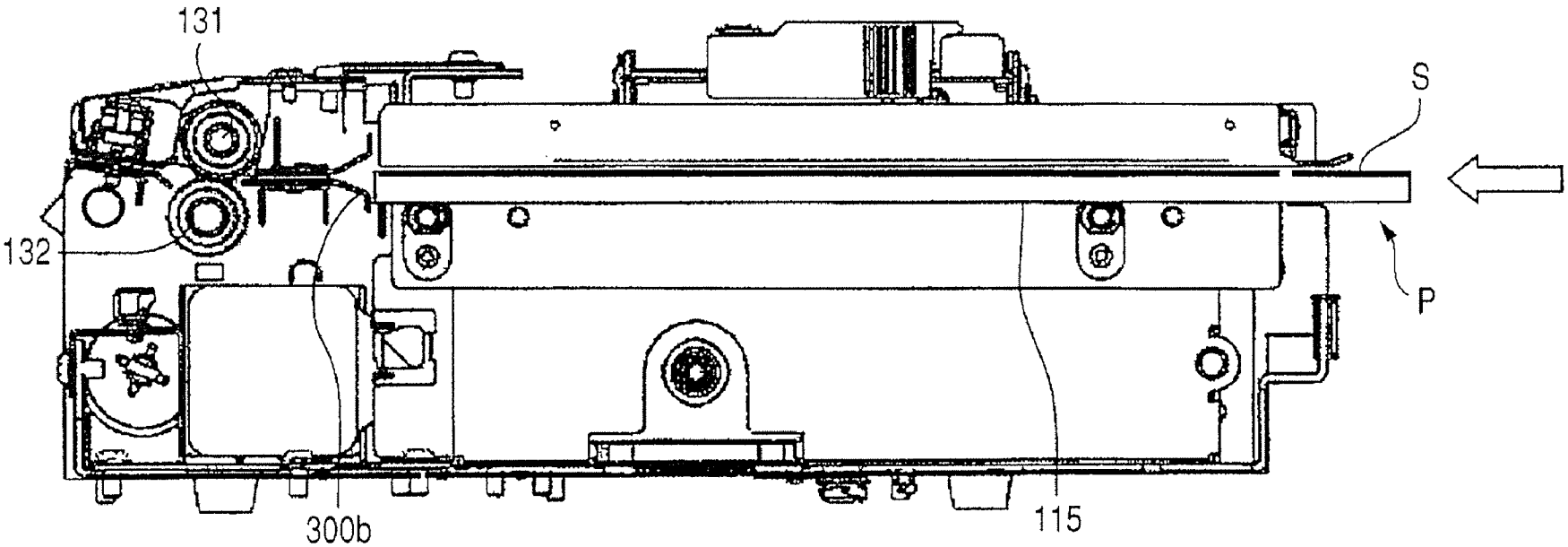
FIG. 19 is another view illustrating the inconvenience peculiar to the conventional skew feed correcting portion.

Here, this coil spring 117*d*, as shown in FIG. 15, is passed over shafts 118*d* and 118*e* and also, is tied from a obliquely feed roller guide portion 100 to a fixed guide portion 110, and the upper portion of the coil spring 117*d* is used as a guide.

The shafts 118*d* and 118*e* are fixed to the obliquely feed roller guide portion 100 side, and are slidably held by the fixed guide portion 110.

Thereby, when the obliquely feed roller guide portion 100 is moved to a position corresponding to a sheet of a small size, the shafts 118*d* and 118*e* come to be contained in the fixed guide portion side. Then, along therewith, the coil spring 117*d* is compressed by being sandwiched between the obliquely feed roller guide portion 100 and the fixed guide portion 110.

While in the foregoing, description has been provided of an example in which the present invention is applied to a registration unit provided with a pair of registration rollers 131 and 132, the present invention is not restricted thereto. For example, even in a conveying portion such as a duplex conveying portion, in a case where it is provided with a fixed guide portion and a movable guide portion constituting a sheet conveying path, and the movable guide portion is moved in the width direction in accordance with the size of the sheet, it is possible to apply the present invention thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-259933, filed Sep. 7, 2005, which is hereby incorporated by reference herein in its entirety.

What is claimed is:

1. A sheet conveying apparatus provided with a skew feed correcting portion for correcting a skew feed of a conveyed sheet, said skew feed correcting portion comprising:

a first guide portion movable in a width direction orthogonal to a conveyance direction of the sheet, said first guide portion having a reference guide extending in the conveyance direction of the sheet and an obliquely feed member configured to obliquely feed a passing sheet so that one side edge of the sheet abuts against said reference guide;

a second guide portion provided opposite to said first guide portion to guide the other side of the sheet by a second guide surface of said second guide portion, said second guide portion being fixed; and an auxiliary guide provided between said first guide surface of said first guide portion, and said second guide surface of said second guide portion and movable in the width direction of the sheet, wherein said first guide portion is moved in advance to a position corresponding to a size of the conveyed sheet, and in operative association with said first guide portion, said auxiliary guide is moved to a guide position corresponding to the size of the sheet between said first guide surface and said second guide surface.

2. A sheet conveying apparatus according to claim 1, further comprising a registration roller sliding in the width direction to align the sheet conveyed along said reference guide by said obliquely feed means with a sheet conveyance reference.

3. A sheet conveying apparatus according to claim 1, wherein said auxiliary guide is supported by said second guide portion so as to be protrudable to a predetermined position in the width direction and in a state in which said auxiliary guide is biased to a side of said first guide portion.

4. A sheet conveying apparatus according to claim 1, wherein said auxiliary guide is provided between said first guide portion and said second guide portion, and is moved while being elastically deformed in operative associated with a movement of said first guide portion.

5. A sheet conveying apparatus according to claim 1, further comprising a link mechanism provided between said first guide portion and said second guide portion for moving said auxiliary guide to the guide position between said first guide portion and said second guide portion in operative association with a movement of said first guide portion.

6. A sheet conveying apparatus according to claim 1, comprising a plurality of auxiliary guides, and a link mechanism provided between said first guide portion and said second guide portion for moving said plurality of auxiliary guides to positions at regular intervals between said first guide portion and said second guide portion in operative association with a movement of said first guide portion.

7. An image forming apparatus including a sheet conveying apparatus provided with a skew feed correcting portion for correcting a skew feed of a conveyed sheet, and an image forming portion for forming an image on the sheet corrected and conveyed from said sheet conveying apparatus, said skew feed correcting portion comprising:

a first guide portion movable in a width direction orthogonal to a conveyance direction of the sheet, said first guide portion having a reference guide extending in the conveyance direction of the sheet and an obliquely feed member configured to obliquely feed a passing sheet so that one side edge of the sheet abuts against said reference guide;

a second guide portion provided opposite to said first guide portion to guide the other side edge of the sheet by a second guide surface of said second guide portion, said second guide portion being fixed; and an auxiliary guide provided between said first guide surface of said first guide portion and said second guide surface of said second guide portion, and movable in the width direction of the sheet, wherein said first guide portion is moved in advance to a position corresponding to a size of the conveyed sheet, and in operative association with said first guide portion, said auxiliary guide is moved to a guide position corresponding to the size of the sheet between said first guide surface and said second guide surface.

8. An image forming apparatus according to claim 7, wherein said auxiliary guide is supported by said second guide portion so as to be protrudable to a predetermined position in the width direction and in a state in which said auxiliary guide is biased to a side of said first guide portion.

9. An image forming apparatus according to claim 7, wherein said auxiliary guide is provided between said first guide portion and said second guide portion, and is moved while being elastically deformed in operative association with a movement of said first guide portion.

10. An image forming apparatus according to claim 7, further comprising a link mechanism provided between said first guide portion and said second guide portion for moving said auxiliary guide to the guide position between said first guide portion and said second guide portion in operative association with a movement of said first guide portion.

11. An image forming apparatus according to claim 7, comprising a plurality of auxiliary guides, and a link mechanism provided between said first guide portion and said second guide portion for moving said plurality of auxiliary guides to positions at regular intervals between said first guide portion and said second guide portion in operative association with a movement of said first guide portion.

* * * * *